US008159402B2

(12) United States Patent
Alameh et al.

(10) Patent No.: US 8,159,402 B2
(45) Date of Patent: Apr. 17, 2012

(54) HANDS FREE CELLULAR COMMUNICATION DEVICE HAVING A DEPLOYABLE ANTENNA

(75) Inventors: Rachid Mohsen Alameh, Crystal Lake, IL (US); Thomas Edward Gitzinger, Libertyville, IL (US); Eric LeRoy Krenz, Crystal Lake, IL (US)

(73) Assignee: Motorola Mobility, Inc., Libertyville, IL (US)

( * ) Notice: Subject to any disclaimer, the term of this patent is extended or adjusted under 35 U.S.C. 154(b) by 337 days.

(21) Appl. No.: 12/468,189

(22) Filed: May 19, 2009

(65) Prior Publication Data

US 2010/0295738 A1 Nov. 25, 2010

(51) Int. Cl.
*H01Q 1/24* (2006.01)

(52) U.S. Cl. ..... 343/702

(58) Field of Classification Search ..... 343/702, 343/718, 700 MS, 876, 846, 725; 455/550.1, 455/575

See application file for complete search history.

(56) References Cited

U.S. PATENT DOCUMENTS

| | | | | |
|---|---|---|---|---|
| 5,677,688 | A | 10/1997 | O'Mara et al. | |
| 6,339,706 | B1 | 1/2002 | Tillgren et al. | |
| 6,373,437 | B1 | 4/2002 | Morningstar | |
| 6,373,942 | B1 | 4/2002 | Braund | |
| 6,453,154 | B1 * | 9/2002 | Haber et al. | 455/90.1 |
| 6,741,189 | B1 | 5/2004 | Gibbons, II et al. | |
| 6,764,012 | B2 | 7/2004 | Connolly et al. | |
| 6,768,804 | B1 | 7/2004 | Isvan | |
| 6,956,531 | B2 | 10/2005 | Suglyama et al. | |
| 7,342,539 | B2 | 3/2008 | Rosenberg et al. | |
| 7,515,944 | B2 * | 4/2009 | Zhu et al. | 455/569.1 |
| 2002/0016155 | A1 | 2/2002 | Charbonnier | |
| 2003/0064732 | A1 | 4/2003 | McDowell et al. | |
| 2003/0157972 | A1 | 8/2003 | Bae | |
| 2003/0210203 | A1 | 11/2003 | Phillips et al. | |
| 2004/0001588 | A1 | 1/2004 | Hairston | |
| 2004/0179694 | A1 | 9/2004 | Alley | |
| 2004/0180691 | A1 | 9/2004 | Cascone | |
| 2004/0185915 | A1 | 9/2004 | Ihara et al. | |

(Continued)

FOREIGN PATENT DOCUMENTS

| | | | |
|---|---|---|---|
| JP | 13085855 | A | 3/2001 |

(Continued)

OTHER PUBLICATIONS

"Plantronics Pulsar 590 Series Stereo Bluetooth Headsets", Plantronics Sound Innovation, Printed Jul. 2005.

*Primary Examiner* — Huedung Mancuso

(57) ABSTRACT

Disclosed is a wireless communication device capable of being positioned in a wearable position adjacent a user's head and including a deployable planar antenna rotatably supported by the housing. The antenna is configured to assume a plurality of orientations with respect to the housing, the plurality of orientations including an orientation being substantially parallel to the housing and one or more orientations being at an angle with respect to the housing. In one embodiment, each of the plurality of orientations coincides with at least one of the plurality of states of the device. A disclosed method of the device includes deploying a low profile planar antenna rotatably supported by the housing, the antenna being configured assume a plurality of orientations with respect to the housing and operating the device in one of the plurality of states depending upon the orientation of the antenna with respect to the housing.

16 Claims, 2 Drawing Sheets

U.S. PATENT DOCUMENTS

2004/0229658 A1* 11/2004 Kim et al. ..... 455/569.1
2005/0058280 A1 3/2005 Ma
2005/0079903 A1 4/2005 Taketomi et al.
2005/0157971 A1 7/2005 Juijve et al.
2005/0184885 A1 8/2005 Tervonen et al.
2006/0029234 A1 2/2006 Sargaison
2006/0097930 A1 5/2006 Rosenberg et al.
2006/0135223 A1 6/2006 Kim
2006/0166702 A1 7/2006 Dietz et al.
2006/0200209 A1 9/2006 Ginggen et al.
2008/0220831 A1 9/2008 Alameh et al.
2008/0231524 A1 9/2008 Zeiger et al.
2008/0238725 A1 10/2008 Gitzinger et al.

FOREIGN PATENT DOCUMENTS

WO 0163888 A1 8/2001
WO 0186923 A 11/2001
WO 2005099105 A 10/2005

* cited by examiner

HANDS FREE CELLULAR COMMUNICATION DEVICE HAVING A DEPLOYABLE ANTENNA

FIELD

Disclosed is a wireless communication device capable of being positioned in a wearable position adjacent a user's head, the device including a deployable planar antenna.

BACKGROUND

Cellular devices are increasing popular for communication, data transmission, and short distance applications such as music replay functions. Cellular telephones typically have a handset form factor configured so that a user holds the device to the ear while it is engaged in operation.

In a handheld device, positioning of an antenna or phone body (which can be part of the antenna) near the user's head may detune the antenna and may thus adversely affect the performance of wireless communication by the handset. A user's hand may cover the device as it is held up to the user's head, so that the amount of power used to drive the cellular antenna must compensate for the fact that a hand is covering the antenna.

An alternative form factor such as a cellular headset provides hands free operation. In one embodiment, a cellular headset may include a housing and an earmount coupled to the housing. The earmount can have any suitable shape, including an arcuate shape of an earhook or an earloop. A benefit of a cellular headset is that a cellular antenna is maintained without interference by the user's hand.

DETAILED DESCRIPTION

Figure 1:
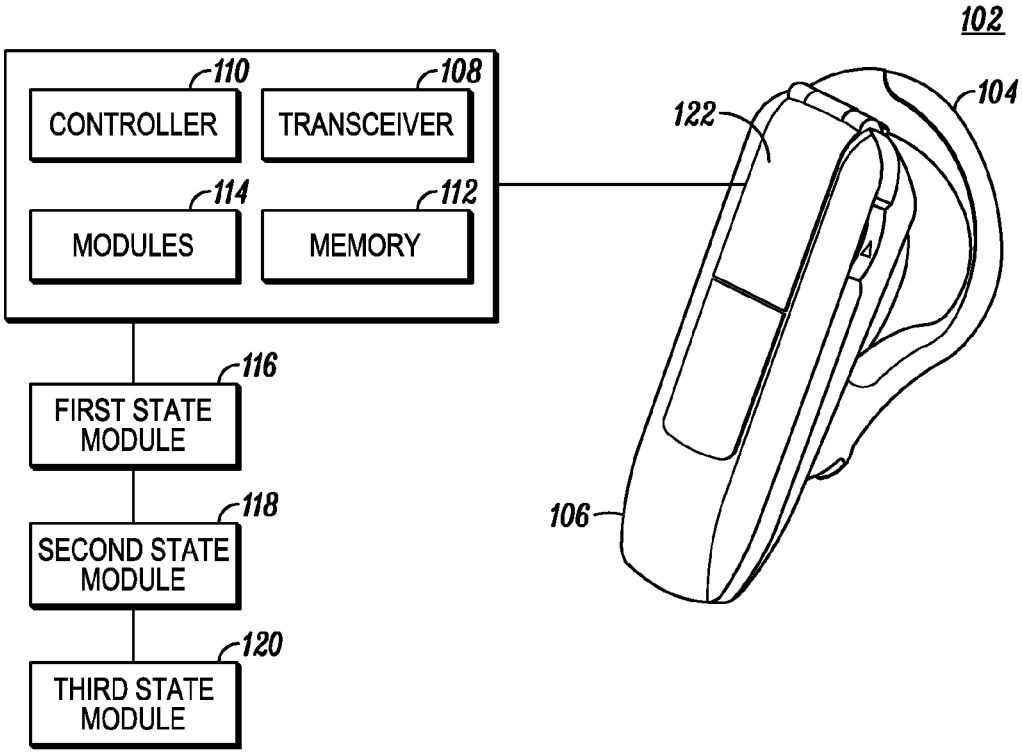
FIG. 1 depicts an embodiment of a cellular headset including the disclosed deployable antenna in a first position flush against the headset housing.

In an embodiment of a cellular headset utilizing an earmount, the overhanging portion of the earmount may make simple situating the device over the ear and thus may be convenient for use. The overhanging portion of the earmount may be stable, even when the device is touched by the user due to the manner in which the overhanging portion hangs down from the ear from which it is balanced. However, it is understood that a cellular headset may be postionable next to the ear of a user in any manner.

Thinner designs such as those carried over the ear are highly desirable. In particular, for an earmounted design to be ergonomically attractive, the thickness of the device is preferrably kept low (i.e. below 10 mm). Thin phone designs results in many antenna challenges especially in small form factor devices such as ear mounted designs having an ergonomically pleasing format. Such space may not be wide enough for a quad band antenna design. It would be beneficial to provide an ergonomically friendly deployable antenna to overcome the thin profile limitation with a minimum protrusion by the antenna.

Disclosed is a wireless communication device capable of being positioned in a wearable position adjacent a user's head and including a deployable planar antenna rotatably supported by the housing. The antenna is configured to assume a plurality of orientations with respect to the housing, the plurality of orientations including an orientation being substantially parallel to the housing and one or more orientations being at an angle with respect to the housing. In one embodiment, each of the plurality of orientations coincides with at least one of the plurality of states of the device. A disclosed method of the device includes deploying a low profile planar antenna rotatably supported by the housing, the antenna being configured assume a plurality of orientations with respect to the housing and operating the device in one of the plurality of states depending upon the orientation of the antenna with respect to the housing. The disclosed low profile antenna may improve RF performance, and incorporate power control without sacrificing ergonomics.

The instant disclosure is provided to explain in an enabling fashion the best modes of making and using various embodiments in accordance with the present invention. The disclosure is further offered to enhance an understanding and appreciation for the invention principles and advantages thereof, rather than to limit in any manner the invention. While the preferred embodiments of the invention are illustrated and described here, it is clear that the invention is not so limited. Numerous modifications, changes, variations, substitutions, and equivalents will occur to those skilled in the art having the benefit of this disclosure without departing from the spirit and scope of the present invention as defined by the following claims.

It is understood that the use of relational terms, if any, such as first and second, up and down, and the like are used solely to distinguish one from another entity or action without necessarily requiring or implying any actual such relationship or order between such entities or actions.

Much of the inventive functionality and many of the inventive principles are best implemented with or in software programs or instructions and integrated circuits (ICs) such as application specific ICs. In the interest of brevity and minimization of any risk of obscuring the principles and concepts according to the present invention, discussion of such software and ICs, if any, is limited to the essentials with respect to the principles and concepts within the preferred embodiments.

FIG. 1 depicts an embodiment of a cellular headset 102 including the disclosed deployable antenna in a first position flush against the headset housing. The headset is capable of being positioned in a wearable position adjacent a user's head. In this embodiment, the cellular headset is configured to utilize an earmount 104. The cellular headset 102 may of course be positionable adjacent a user's head in any manner, such as being part of a hat or helmet. The housing 106 of the cellular headset includes a transceiver 108 capable of communicating with a base station (not shown). The transceiver 108 is in communication with a controller 110 which is in communication with memory 112 and modules 114.

The device 102, of course, may have many different states, including an on state, an off state and a stand-by state. A hands free device 102 may be activated and deactivated in different manners. For example, in one embodiment, a hands free device may be activated and deactivated with speech recognition commands. In one embodiment, the disclosed device includes power control functionality via the deployable antenna which is discussed in detail below.

The first state module 116, for example, may detect the off state of the device. The second state module 118, for example, may detect the on state of the device. In another embodiment, the second state module 118 may provide that the device 102 is capable of receiving communication. The third state module 120 may provide that the device 102 is capable of receiving communication with a different reception than when the device is in its second state. The third state may provide, for example, a better reception than the second state.

The modules can carry out certain processes of the methods as described herein. Steps of methods may involve modules and modules may be inferred by the methods discussed herein. The modules can be implemented in software, such as in the form of one or more sets of prestored instructions, and/or hardware, which can facilitate the operation of the mobile station or electronic device as discussed below. The modules may be installed at the factory or can be installed after distribution by, for example, a downloading operation. The operations in accordance with the modules will be discussed in more detail below.

A planar antenna 122 is shown in a first position, that being flush with the housing 106 of the device 102. When the antenna 122 is in the first position, the device may be, for example, in the off state or stand-by state. The antenna 122 may be low profile, and may have any suitable dimensions with respect to the configuration and size of the housing 106. In this example, the antenna 112 is adjacent the end of the housing 106 that would sit closest to the earmount 104.

Figure 2:
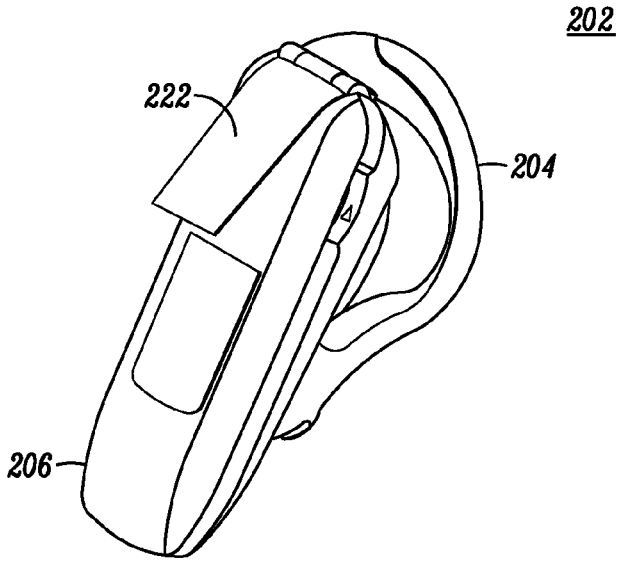
FIG. 2 depicts an embodiment of a cellular headset in a second position, at an angle from the headset housing.

FIG. 2 depicts an embodiment of a cellular headset 202 (similar the headset 102 of FIG. 1) in a second position, at an angle from the headset housing. In this embodiment, the cellular headset is configured to utilize an earmount 204. The antenna 222 is in a second position which is not flush to the housing. In this way, the antenna 222 is ergonomically friendly since it is a deployable antenna which can overcome the thin profile limitation of the cellular headset 202 with minimum protrusion therefrom.

Figure 3:
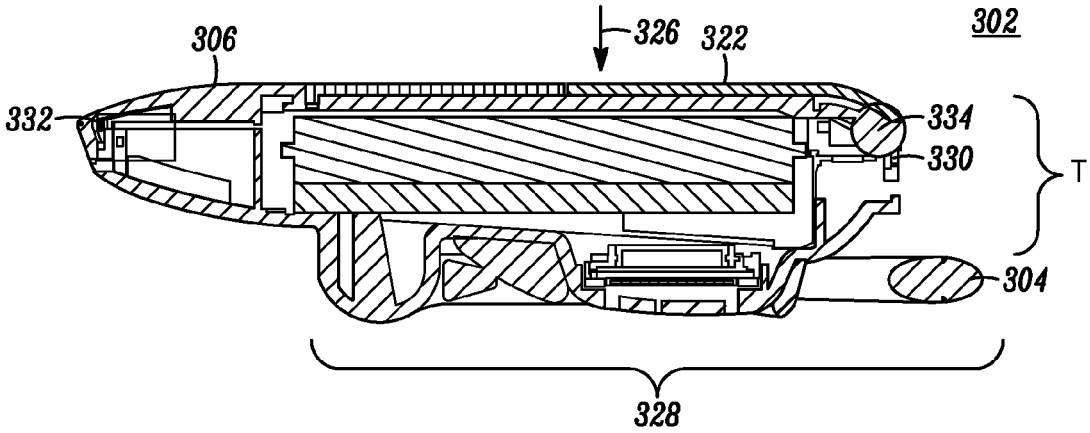
FIG. 3 is a side view of an embodiment of a cellular headset where the planar antenna is flush with the housing of the device.

FIG. 3 is a side view of an embodiment of a cellular headset 302 where the planar antenna 322 is shown as flush with the housing 306 of the device 302. As mentioned above, the housing 306 may be a thin housing, such as 10 mm in thickness T. Thus, the planar antenna 322 may be but a fraction of thickness T. The antenna 322 may be deployed from being flush against the housing 306 in any number of manners. Once deployed, there is space between the housing 306 and the antenna 322.

Deployment of the antenna may be made provided in any suitable manner. In one embodiment, the antenna 322 may be pressed to deploy. The arrow 326 depicts the direction the antenna 322 may be pressed against the housing 306, for example, by a user's hand. The bracket 328 depicts the area of the housing 306 that would be positioned adjacent a user's head in the depicted earmount 304 embodiment. In this way, the press of the antenna 322 against the housing 306 may be a firm press when the device 302 is positioned adjacent a user's head. Accordingly, the deployment of the antenna 322 may be a single handed operation for the user. When deployed, the antenna 322 may rotate about an end 330 of the housing 306, opposite, for example and end of the housing supporting a microphone 332. Any spring loaded rotating hinge 334 is within the scope of this discussion.

Figure 4:
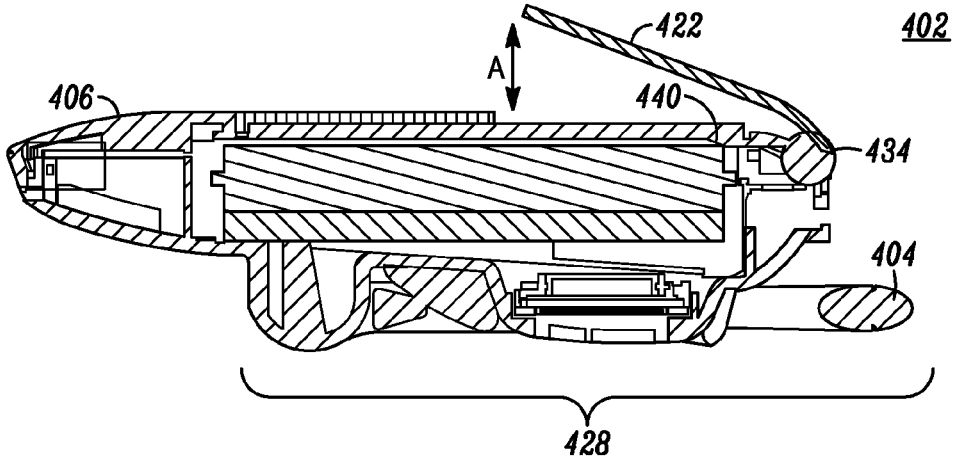
FIG. 4 is a side view of an embodiment of a cellular headset where the planar antenna 4 is shown as deployed with respect to the housing of the device.

FIG. 4 is a side view of an embodiment of a cellular headset 402 where the planar antenna 422 is shown as deployed with respect to the housing 406 of the device 402, and an angle A from the housing. As mentioned any spring loaded rotating hinge 434 is within the scope of this discussion. The antenna 422, for example, may be a Planar Inverted-Type Antenna (PIFA) which may rely upon spacing between the antenna element 422 and a ground plane 440 to yield a sufficient bandwidth to cover certain cellular bands, such as for operation at 850 MHz. In this deployed position, the antenna 422 is away from the user, providing free volume to operate. Moreover, when the area of the housing 406 depicted by bracket 428 is positioned adjacent the head, a user's hand may not cover the device 402, so that power to compensate for the fact that a hand is covering the antenna 422 is not needed to drive the antenna 422.

The angle A may be any suitable angle. For example, angle A may be 20 degrees. The act of deployment of the antenna 422 may provide power control functionality via the deployable antenna mechanism. For example, when the antenna 422 is flush with the housing as depicted in FIG. 3, the device 402 may be in a first state, that is, being in the off state. The first state module 116 (see FIG. 1) for example, may detect the off state of the device. When the antenna 422 has been deployed to an angle A from the housing 406, the device 402 may be in an on state. The second state module 118, for example, may detect the on state of the device.

Figure 5:
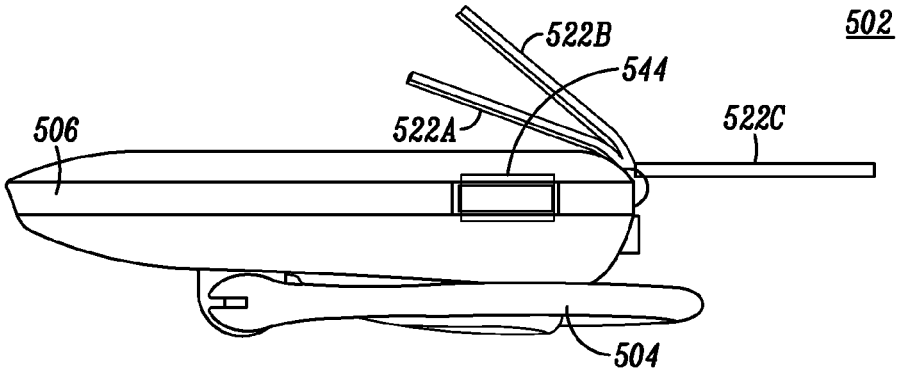
FIG. 5 is a side view of an embodiment of a cellular headset where the planar antenna is shown as deployed in three positions with respect to the housing of the device.

FIG. 5 is a side view of an embodiment of a cellular headset 502 where the planar antenna 522 is shown as deployed in three positions 522*a*, 522*b* and 522*c* with respect to the housing 506 of the device 502. That is, the antenna 522 is configured to assume a plurality of orientations with respect to the housing 506, the plurality of orientations including an orientation being substantially parallel to the housing (see FIGS. 1 and 3) and one or more orientations being at an angle A (see FIG. 4) with respect to the housing 506.

The different states of the device 502 in this way, may coincide with the deployment of the antenna 522. It is understood that any sequence of states with respect to deployment of the antenna 522 is within the scope of this discussion. For example, in another embodiment, the second state module 118 (see FIG. 1) may provide that the device 502 is capable of receiving communication. The third state module 120 may provide that the device 502 is capable of receiving communication with a different reception than when the device 502 is in its second state. The third state may provide, for example, a better reception than the second state.

The antenna 522 may be also capable of assuming a different mode corresponding to its deployment. For example, in the position depicted by the antenna 522*c*, the antenna may assume the mode of a WHIP antenna, or a mass dipole looking antenna. The antenna may be furthermore extendable. Sliding or folding plate may increase size of antenna along its length and/or width.

As mentioned, the deployment of the antenna may be provided in any suitable manner. For example, a button 544 may be used to release the spring loaded hinge 434 (see FIG. 4). Deploying the disclosed low profile planar antenna and operating the device in one of the plurality of states depending upon the orientation of the antenna with respect to the housing can improve RF performance, and can incorporate power control without sacrificing ergonomics. Moreover, the disclosed ergonomically friendly deployable antenna can overcome the thin profile limitation of wearable cellular headset with minimum protrusion.

This disclosure is intended to explain how to fashion and use various embodiments in accordance with the technology rather than to limit the true, intended, and fair scope and spirit thereof. The foregoing description is not intended to be exhaustive or to be limited to the precise forms disclosed.

Modifications or variations are possible in light of the above teachings. The embodiment(s) was chosen and described to provide the best illustration of the principle of the described technology and its practical application, and to enable one of ordinary skill in the art to utilize the technology in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally and equitably entitled.

The invention claimed is:

1. A wireless communication device capable of being positioned in a wearable position adjacent a user's head, the device configured to have a plurality of states, the device comprising:

a housing;

a wireless transceiver supported by the housing, the wireless transceiver being configured to communicate with a base station; and a deployable planar antenna coupled to the wireless transceiver and rotatably supported by the housing, the antenna configured to assume a plurality of orientations with respect to the housing, the plurality of orientations including an orientation being substantially parallel to the housing and one or more orientations being at an angle with respect to the housing.

2. The device of claim 1, wherein the deployable low profile planar antenna is configured to rotate about a first end of the housing opposite a second end of the housing configured to support a microphone.

3. The device of claim 1, wherein the plurality of orientations includes a first orientation where the antenna is configured to operate as a planar inverted F-type antenna, and a second orientation where the antenna is configured to operate as a whip antenna.

4. The device of claim 1, wherein the deployable low profile planar antenna is configured to deploy when pressed.

5. The device of claim 1, wherein the device includes a button to release the deployable low profile planar antenna.

6. The device of claim 1, wherein the deployable low profile planar antenna is spring loaded.

7. The device of claim 1, wherein each of the plurality of orientations coincides with at least one of the plurality of states of the device.

8. The device of claim 1, further comprising:

an earmount supported by the housing, the earmount configured to position the device in a wearable position adjacent a user's head.

9. The device of claim 1, further comprising:

an extendable planar portion of the antenna configured to increase the size of the antenna.

10. A wireless communication device having a housing, the device capable of being positioned in a wearable position adjacent a user's head, the device configured to have a plurality of states, the device comprising:

a housing;

a wireless transceiver supported by the housing, the wireless transceiver being configured to communicate with a base station; and a deployable low profile planar antenna coupled to the wireless transceiver and rotatably supported by the housing, the antenna being configured to be deployed by a single action wherein the single action is a press against the antenna or a press of a button of the housing.

11. The device of claim 10, further comprising:

an earmount supported by the housing, the earmount configured to position the device in a wearable position adjacent a user's head.

12. A method of a wireless communication device having a housing, the device capable of being positioned in a wearable position adjacent a user's head, the device configured to have a plurality of states, the method comprising:

deploying a low profile planar antenna rotatably supported by the housing, the antenna being configured assume a plurality of orientations with respect to the housing; and operating the device in one of the plurality of states depending upon the orientation of the antenna with respect to the housing, wherein when the antenna is deployed at a first angle with respect to the housing, the state of the device is that it is capable of receiving communications and wherein when the antenna is deployed at a second angle with respect to the housing, the state of the device is that it has a different reception performance than the reception performance at the first angle.

13. The method of claim 12, wherein when the antenna is not deployed, the state of the device is off.

14. The method of claim 12, wherein deploying the low profile planar antenna comprises:

pressing against the antenna.

15. The method of claim 11, wherein deploying the low profile shell antenna comprises:

pressing a button of the housing.

16. The method of claim 11, further comprising:

supporting the housing with an earmount to position the device in a wearable position adjacent a user's head.

* * * * *